US007166962B2

(12) United States Patent
Min et al.

(10) Patent No.: US 7,166,962 B2
(45) **Date of Patent: *Jan. 23, 2007**

(54) PLASMA DISPLAY PANEL WITH IMPROVED BRIGHTNESS AND CONTRAST

(75) Inventors: Jong-Sul Min, Hwasung-si (KR); Chang-Wan Hong, Yongin-si (KR); Young-Sun Kim, Suwon-si (KR); Young-Soo Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/070,376

(22) Filed: Mar. 3, 2005

(65) Prior Publication Data

US 2005/0225240 A1 Oct. 13, 2005

(30) Foreign Application Priority Data

Apr. 9, 2004 (KR) ..... 10-2004-0024510

(51) Int. Cl.
*H01J 17/49* (2006.01)

(52) U.S. Cl. ..... 313/587; 313/582

(58) Field of Classification Search ..... 313/582
See application file for complete search history.

(56) References Cited

U.S. PATENT DOCUMENTS

| | | | | |
|---|---|---|---|---|
| 5,939,826 | A * | 8/1999 | Ohsawa et al. | 313/582 |
| 6,417,619 | B1 * | 7/2002 | Yasunori et al. | 313/582 |
| 6,531,817 | B1 * | 3/2003 | Holtslag et al. | 313/582 |
| 6,680,762 | B1 * | 1/2004 | Fukuda et al. | 349/95 |
| 2002/0039157 | A1 * | 4/2002 | Nakanishi et al. | 349/95 |
| 2005/0162087 | A1 * | 7/2005 | Kim et al. | 313/587 |
| 2005/0225239 | A1 * | 10/2005 | Min et al. | 313/582 |

FOREIGN PATENT DOCUMENTS

| | | |
|---|---|---|
| JP | 64-035648 | 3/1989 |
| JP | 05-142511 | 6/1993 |
| JP | 08-152594 | 6/1996 |
| JP | 09-311329 | 12/1997 |
| JP | 10-214567 | 8/1998 |
| JP | 2001-154597 | 6/2001 |
| KR | 1998-085527 | 12/1998 |
| KR | 1999-004507 | 1/1999 |
| KR | 1999-043630 | 6/1999 |
| KR | 1999-004507 | 9/1999 |
| KR | 2001-041206 | 5/2001 |
| KR | 2003-022581 | 3/2003 |

* cited by examiner

*Primary Examiner*—Nimeshkumar D. Patel
*Assistant Examiner*—Peter Macchiarolo
(74) *Attorney, Agent, or Firm*—Roylance, Abrams, Berdo & Goodman, L.L.P.

(57) ABSTRACT

Disclosed is a plasma display panel comprises a lower substrate and an upper substrate, spaced apart by a predetermined distance to define a discharge space therebetween; a plurality of barrier ribs between the lower substrate and the upper substrate, partitioning the discharge space to form a plurality of discharge cells; a plurality of address electrodes formed in parallel on the upper surface of the lower substrate; a plurality of discharge electrodes formed at an angle to the address electrodes on the lower surface of the upper substrate; a fluorescent layer formed on the inner walls of the discharge cells; and an external light shielding member formed on the upper substrate, preventing external light from entering the discharge cells, wherein the lower surface of the upper substrate has a plurality of cylindrical lenses, corresponding to each of the discharge cells.

44 Claims, 7 Drawing Sheets

PLASMA DISPLAY PANEL WITH IMPROVED BRIGHTNESS AND CONTRAST

CROSS-REFERENCE TO RELATED APPLICATIONS

This application claims the benefit under 35 U.S.C. §119 (a) of Korean Patent Application No. 10-2004-0024510, filed in the Korean Intellectual Property Office on Apr. 9, 2004, the entire disclosure of which is hereby incorporated by reference.

BACKGROUND OF THE INVENTION

1. Field of the Invention

The present invention relates to a plasma display panel. More particularly, the present invention relates to a plasma display panel with an improved structure that can enhance brightness, and can enhance contrast, for example, when a plasma display panel is operated in a brightly lit room.

2. Description of the Related Art

A plasma display panel (PDP) is an apparatus to form an image using an electrical discharge. Its superior performance in terms of brightness and viewing angle has ensured its popularity. In such a PDP, a DC or AC voltage applied to electrodes causes a gas discharge between the electrodes, and ultraviolet rays generated by the discharge excite a fluorescent material, which emits a visible light.

PDPs are classified as either a DC type or an AC type, according to the type of discharge. The DC type PDP has a structure in which all electrodes are exposed to a discharge space, and charges move directly between the electrodes. The AC type PDP has a structure in which at least one electrode is covered with a dielectric layer, and charges do not move directly between the corresponding electrodes but discharge is performed by wall charges.

Also, PDPs may be classified as a facing discharge type or a surface discharge type, according to the arrangement of the electrodes. The facing discharge type PDP has a structure in which a pair of sustain electrodes are formed respectively on an upper substrate and a lower substrate, and discharge occurs perpendicular to the substrate. The surface discharge type PDP has a structure in which a pair of sustain electrodes are formed on the same substrate, and discharge occurs parallel to the substrate.

The facing discharge type PDP has a high luminous efficiency, but a disadvantage being that the fluorescent layer is easily deteriorated. For this reason, the surface discharge type PDP is presently more common.

FIGS. 1 and 2 show the construction of a conventional surface discharge type PDP. In FIG. 2, the upper substrate 20 is shown rotated by 90 degrees for easier understanding of the inner structure of the PDP.

Referring to FIGS. 1 and 2, the conventional PDP includes a lower substrate 10 and an upper substrate 20 facing each other.

On the upper surface of the lower substrate 10, a plurality of address electrodes 11 are arranged in a stripe configuration. The address electrodes 11 are covered by a first dielectric layer 12 (preferably white). On the first dielectric layer 12, a plurality of barrier ribs 13 are formed at a predetermined spacing to prevent electrical and optical cross-talk between discharge cells 14. On the inner surfaces of the discharge cells 14, which are partitioned by the barrier ribs 13, a red (R), green (G) and blue (B) fluorescent layer 15 is coated to a predetermined thickness. The discharge cells 14 are filled with a discharge gas, which is typically a mixture of neon (Ne) and a small amount of xenon (Xe), as is generally used for plasma discharge.

The upper substrate 20 is a transparent substrate, which transmits visible light, and is preferably made of glass. The upper substrate 20 is coupled to the lower substrate 10 having the barrier ribs 13. On the lower surface of the upper substrate 20, sustaining electrodes 21*a* and 21*b* are formed in pairs and are perpendicular to the address electrodes 11 and are arranged in a stripe configuration. The sustaining electrodes 21*a* and 21*b* are formed of a transparent conductive material, such as indium tin oxide (ITO), to transmit visible light. In order to reduce the line resistance of the sustaining electrodes 21*a* and 21*b*, bus electrodes 22*a* and 22*b* are formed of a metal, on the lower surface of the respective sustaining electrodes 21*a* and 21*b*, to a width less than that of the sustaining electrodes 21*a* and 21*b*. These sustaining electrodes 21*a* and 21*b* and the bus electrodes 22*a* and 22*b* are covered with a transparent second dielectric layer 23. On the lower surface of the second dielectric layer 23, a protective layer 24 is formed. The protective layer 24 prevents the second dielectric layer 23 from damage by plasma sputtering, and emits secondary electrons, thereby lowering discharge voltages. The protective layer 24 is generally formed of magnesium oxide (MgO). A plurality of black stripes 30 are formed at a predetermined spacing, parallel to the sustaining electrodes 21*a* and 21*b*, on the upper surface of the upper substrate 20, to prevent external light from entering the panel.

The conventional PDP constructed as above generally uses a cycle of two operations: address discharge and sustaining discharge. The address discharge occurs between the address electrode 11 and any one of the sustaining electrodes 21*a* and 21*b*, and during the address discharge, wall charges are formed. The sustaining discharge is caused by a potential difference between the sustaining electrodes 21*a* and 21*b* positioned at the discharge cells 14 in which the wall charges are formed. During the sustaining discharge, the florescent layer 15 of the corresponding discharge cell is excited by ultraviolet rays generated from the discharge gas, emitting visible lights. The visible light emitted through the upper substrate 20 form the image.

However, when the conventional PDP constructed as above is used in brightly lit room conditions, external light enters the discharge cells 14, mixing with the light generated by the discharge cells 14. This lowers the contrast and reduces the image display performance of the PDP when used in a brightly lit room.

SUMMARY OF THE INVENTION

The present invention provides a PDP with better brightness, and better contrast in a brightly lit room, by improving the structure of an upper substrate.

According to an aspect of the present invention, there is provided a plasma display panel, comprising a lower substrate and an upper substrate, spaced apart from each other by a predetermined distance to define a discharge space therebetween; a plurality of barrier ribs between the lower substrate and the upper substrate, partitioning the discharge space to form a plurality of discharge cells; a plurality of address electrodes are formed in parallel on the upper surface of the lower substrate; a plurality of discharge electrodes are formed at an angle to the address electrodes on the lower surface of the upper substrate; a fluorescent layer is formed on the inner walls of the discharge cells; and an external light shielding member is formed on the upper substrate to prevent external light from entering the discharge cells, wherein the lower surface of the upper substrate has a plurality of cylindrical lenses, which correspond to each of the discharge cells, to focus visible lights generated by discharge and emit the visible light out of the PDP.

It is preferable that the cylindrical lenses are formed integral with the upper substrate. The cylindrical lenses may be formed parallel to the address electrodes. At this point, the external light shielding member may comprise a plurality of stripes (preferably black) that are formed parallel to the address electrodes on the upper surface of the upper substrate. It is preferable that the stripes are formed in locations where no visible light is emitted by the discharge cells. The stripes may comprise a conductive film for shielding electromagnetic interference (EMI). It is preferable that the upper surface of the upper substrate between the stripes be treated with a non-glare material.

Alternatively, the cylindrical lenses may be formed perpendicular to the address electrodes. At this point, the external light shielding member may comprise a plurality of black stripes formed perpendicular to the address electrodes on the upper surface of the upper substrate. The discharge electrodes may be formed on the lower surfaces of the cylindrical lenses.

A transparent material layer may be formed to cover the lower surfaces of the cylindrical lenses. The discharge electrodes may be formed on the lower surface of the transparent material layer.

The barrier ribs may be formed parallel to the address electrodes, and bus electrodes may be formed on the lower surfaces of the discharge electrodes.

Also, a first dielectric layer covering the address electrodes may be formed on the upper surface of the lower substrate, and a second dielectric layer covering the discharge electrodes may be formed on the lower surface of the upper substrate. Further, a protective layer may be formed on the lower surface of the second dielectric layer.

According to another aspect of the present invention, there is provided a plasma display panel comprising a lower substrate and an upper substrate, spaced apart from each other by a predetermined distance to define a discharge space therebetween; a plurality of barrier ribs are arranged between the lower substrate and the upper substrate, thereby partitioning the discharge space to form a plurality of discharge cells; a plurality of address electrodes are formed in parallel on the upper surface of the lower substrate; a plurality of discharge electrodes are formed at an angle to the address electrodes on the lower surface of the upper substrate; a fluorescent layer is formed on the inner walls of the discharge cells; and an external light shielding member is formed on the upper substrate to prevent external light from entering the discharge cells, wherein the lower surface of the upper substrate has cylindrical lenses, each of which is formed corresponding to two or more discharge cells, to focus visible light generated by a discharge and emit the visible light from the discharge out of the PDP.

It is also preferable that each of the cylindrical lenses corresponds to three discharge cells forming one pixel. Additionally, it is preferable that the cylindrical lenses are parallel to the address electrodes.

BRIEF DESCRIPTION OF THE DRAWINGS

The above and other features and advantages of the present invention will become more apparent by describing in detail exemplary embodiments thereof with reference to the attached drawings in which.

In the drawings, it should be understood that like reference numbers refer to similar features, structures, and elements.

DETAILED DESCRIPTION OF EXEMPLARY EMBODIMENTS

Embodiments of the present invention will now be described more fully with reference to the accompanying drawings, in which exemplary embodiments of the invention are shown.

Figure 1:
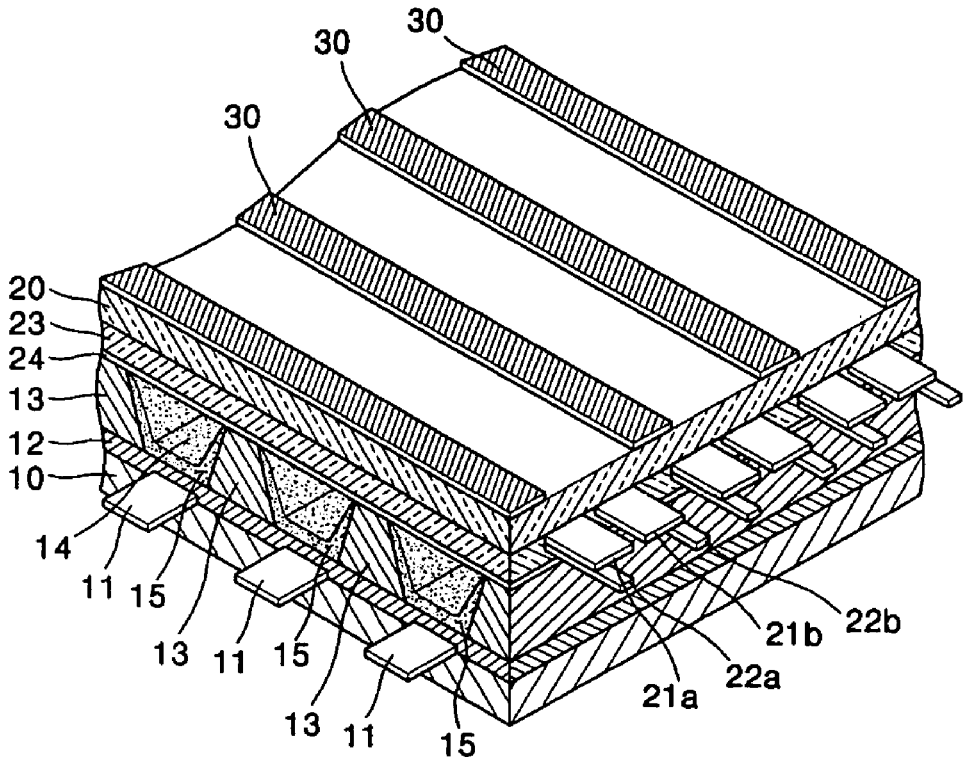
FIG. 1 (PRIOR ART)
FIG. 1 is a cutaway perspective view of a conventional surface discharge type PDP.
Figure 2:
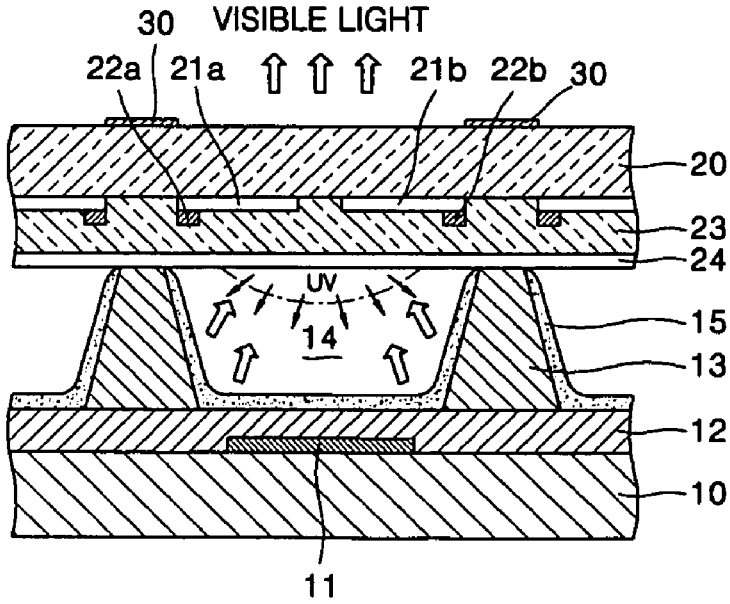
FIG. 2 (PRIOR ART)
FIG. 2 is a cross-sectional view illustrating the inner structure of the PDP of FIG. 1.
Figure 3:
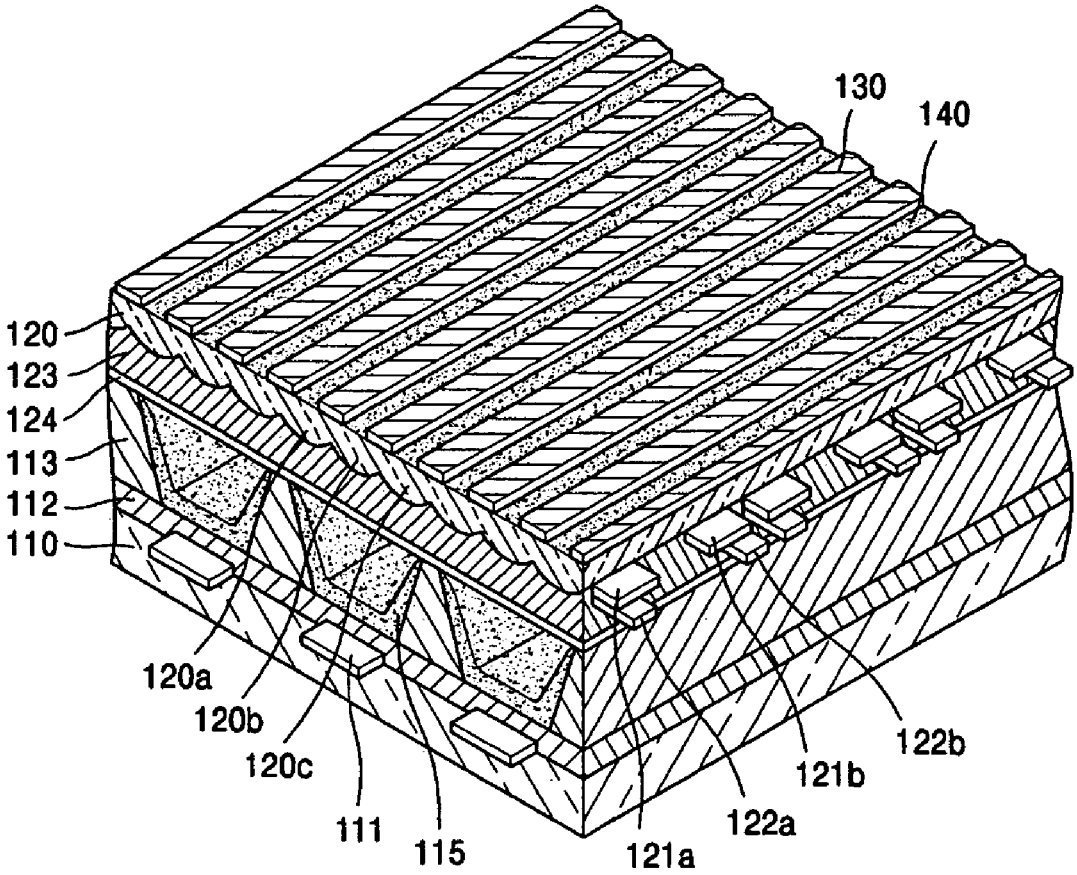
FIG. 3 is a cutaway perspective view of a PDP according to an embodiment of the present invention.
Figure 4:
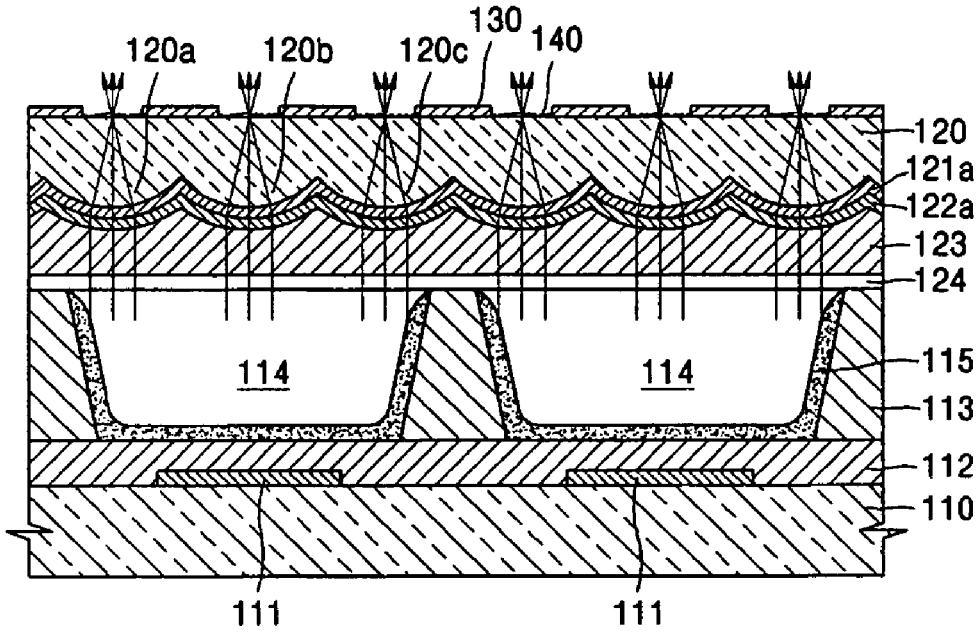
FIG. 4 is a cross-sectional view illustrating the inner structure of the PDP of FIG. 3.

FIG. 3 is a cutaway perspective view of a PDP according to an embodiment of the present invention, and FIG. 4 is a cross-sectional view illustrating the inner structure of the PDP of FIG. 3.

Referring to FIGS. 3 and 4, the PDP comprises a lower substrate 110 and an upper substrate 120, facing each other at a predetermined spacing. This space between the lower substrate 110 and the upper substrate 120 corresponds to a discharge space where plasma discharge occurs.

The lower substrate 110 is preferably formed of glass. A plurality of address electrodes 111 are formed in parallel with one another in a stripe configuration on the upper surface of the lower substrate 110. A first dielectric layer 112 is formed on the address electrodes 111 to cover the address electrodes 111 and the lower substrate 110. The first dielectric layer 112 can be formed by coating a dielectric material (preferably white) to a predetermined thickness.

A plurality of barrier ribs 113 are formed in parallel at a predetermined spacing, on the upper surface of the first dielectric layer 112. The barrier ribs 113 partition the discharge space between the lower substrate 110 and the upper substrate 120, thereby defining discharge cells 114. The barrier ribs 113 prevent electrical and optical cross-talk between adjacent discharge cells 114, thereby enhancing color purity. A red (R), green (G) and blue (B) fluorescent layer 115 is formed to a predetermined thickness on the upper surface of the first dielectric layer 112 and the sides of the barrier ribs 113 forming the inner walls of the discharge cells 114. The fluorescent layer 115 is excited by ultraviolet rays generated by the plasma discharge, thereby emitting visible light of a certain color. The discharge cells 114 are preferably filled with a discharge gas, which is a mixture of neon (Ne) and a small amount of xenon (Xe), as is generally used for plasma discharge.

The upper substrate 120 is transparent to visible light, and is preferably formed of glass. A plurality of cylindrical lenses 120*a*, 120*b* and 120*c* are formed on the lower surface of the upper substrate 120. The cylindrical lenses 120*a*, 120*b* and 120*c* correspond to each of the discharge cells 114, and are formed parallel to the address electrodes 111. It is preferable that the cylindrical lenses 120*a*, 120*b* and 120*c* are formed integral with the upper substrate 120, which can be achieved by processing the lower surface of the upper substrate 120. As shown in FIG. 4, the cylindrical lenses 120*a*, 120*b* and 120*c* focus the visible light generated in the discharge cells 114 and emit the visible light out of the PDP. Thus, the plurality of cylindrical lenses 120*a*, 120*b* and 120*c* corresponding to each of the discharge cells 114 to reduce the loss of visible light generated in the discharge cells 114 and at the same time enhance light integrity, thereby further enhancing the brightness of the PDP.

Although the present embodiment shows three cylindrical lenses 120*a*, 120*b* and 120*c* corresponding to each of the discharge cells 114, the number of cylindrical lenses corresponding to each of the discharge cells 114 may be changed to two or four or more.

On the lower surfaces of the cylindrical lenses 120*a*, 120*b* and 120*c*, discharge electrodes 121*a* and 121*b* for sustaining a discharge are formed in a pair for each discharge cell. The first and second discharge electrodes 121*a* and 121*b* are formed perpendicular to the address electrodes 111. The first and second discharge electrodes 121*a* and 121*b* are preferably formed of a transparent conductive material, such as indium tin oxide (ITO), in order to transmit the visible light generated in the discharge cells 114. On the lower surface of the first and second discharge electrodes 121*a* and 121*b*, first and second bus electrodes 122*a* and 122*b*, which are preferably made of metal, are formed. The first and second bus electrodes 122*a* and 122*b* are electrodes to decrease line resistance of the first and second discharge electrodes 121*a* and 121*b*, and are preferably narrower than the first and second discharge electrodes 121*a* and 121*b*.

On the lower surface of the cylindrical lenses 120*a*, 120*b* and 120*c* is formed a second dielectric layer 123 covering the first and second discharge electrodes 121*a* and 121*b* and the first and second bus electrodes 122*a* and 122*b*. The second dielectric layer 123 can be formed by coating a preferably transparent dielectric material on the lower surface of the upper substrate 120 to a predetermined thickness.

A protective layer 124 is formed on the lower surface of the second dielectric layer 123. The protective layer 124 prevents the second dielectric layer 123 and the first and second discharge electrodes 121*a* and 121*b* from being damaged by plasma sputtering and emits secondary electrons, thereby lowering discharge voltage. The protective layer 124 can preferably be formed by coating magnesium oxide (MgO) on the lower surface of the second dielectric layer 123 to a predetermined thickness.

An external light shielding member is provided on the upper surface of the upper substrate 120 to prevent external light from entering the discharge cells 114 through the upper substrate 120. The external light shielding member is preferably formed of a plurality of parallel stripes 130 (preferably black) on the upper surface of the upper substrate 120 at a predetermined spacing. The stripes 130 are preferably of a uniform width and are parallel with the address electrodes 111 and the cylindrical lenses 120*a*, 120*b* and 120*c*. The stripes 130 are formed where no visible light is emitted by the discharge cells 114. Thus, when the stripes 130 are formed on the upper surface of the upper substrate 120, the visible light generated by the discharge cells 114 is focused into the upper surface 140 of the upper substrate 120 as shown in FIG. 4, and is then diffused and emitted out of the PDP. Hence, since the stripes 130 can cover more of the upper surface of the upper substrate 120 than in the conventional PDP, external light can be more effectively prevented from entering the discharge cells 114. As a result, contrast of the PDP when used in, for example, brightly lit room conditions, may be enhanced. The stripes 130 may include a conductive film for shielding electromagnetic interference (EMI).

Non-glare treatments are applied to portions of the upper surface 140 of the upper substrate 120 between the black stripes 130 to prevent external light from being reflected by the upper substrate 120.

In the PDP constructed as above, when an address discharge occurs between the address electrode 111 and any one of the sustaining electrodes 121*a* and 121*b*, wall charges are formed. Thereafter, when an AC voltage is applied to the first and second discharge electrodes 121*a* and 121*b*, a sustaining discharge occurs inside the discharge cells 114 where the wall charges are formed. The sustaining discharge causes the discharge gases to generate ultraviolet rays, which excite the fluorescent layer 115 to generate visible light.

The visible light generated in the discharge cells 114 is focused onto the non-glare treated regions of the upper surface 140 of the upper substrate 120 by cylindrical lenses 120*a*, 120*b* and 120*c*, and are then diffused and emitted out of the PDP. Thus, the loss of visible light generated in discharge cells 114 can be reduced and light integrity can be enhanced.

Moreover, the area covered by the stripes 130 formed on the upper surface of the upper substrate 120 can be higher than in the conventional PDP, further enhancing the contrast of the PDP when used in, for example, brightly lit room conditions.

Figure 5:
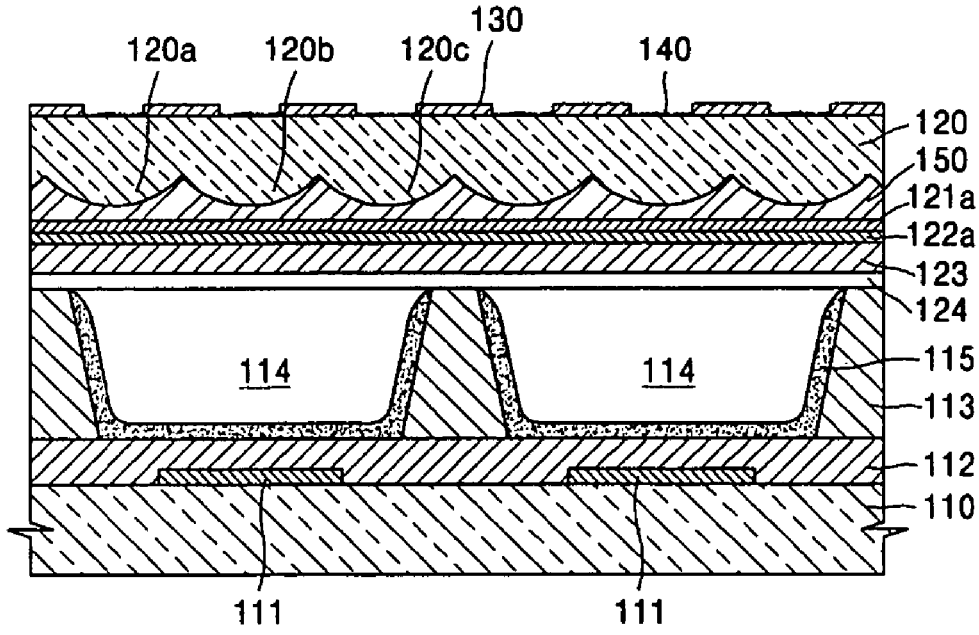
FIG. 5 is a cross-sectional view illustrating a modification of the PDP of FIG. 3.

FIG. 5 is a cross-sectional view illustrating another embodiment of the PDP of FIG. 3. Referring to FIG. 5, a transparent material layer 150 is formed to cover the lower surfaces of the cylindrical lenses 120*a*, 120*b* and 120*c*. First and second discharge electrodes 121*a* and 121*b* are formed on the flat lower surface of the transparent material layer 150. First and second bus electrodes 122*a* and 122*b* are formed on the lower surfaces of the first and second discharge electrodes 121*a* and 121*b*. Also, a second dielectric layer 123 covering the first and second discharge electrodes 121*a* and 121*b* and the first and second bus electrodes 122*a* and 122*b* is formed on the lower surface of the preferably transparent material layer 150. Thus, the transparent material layer 150 aids the formation of the first and second discharge electrodes 121*a* and 121*b* and the first and second bus electrodes 122*a* and 122*b*.

Figure 6:
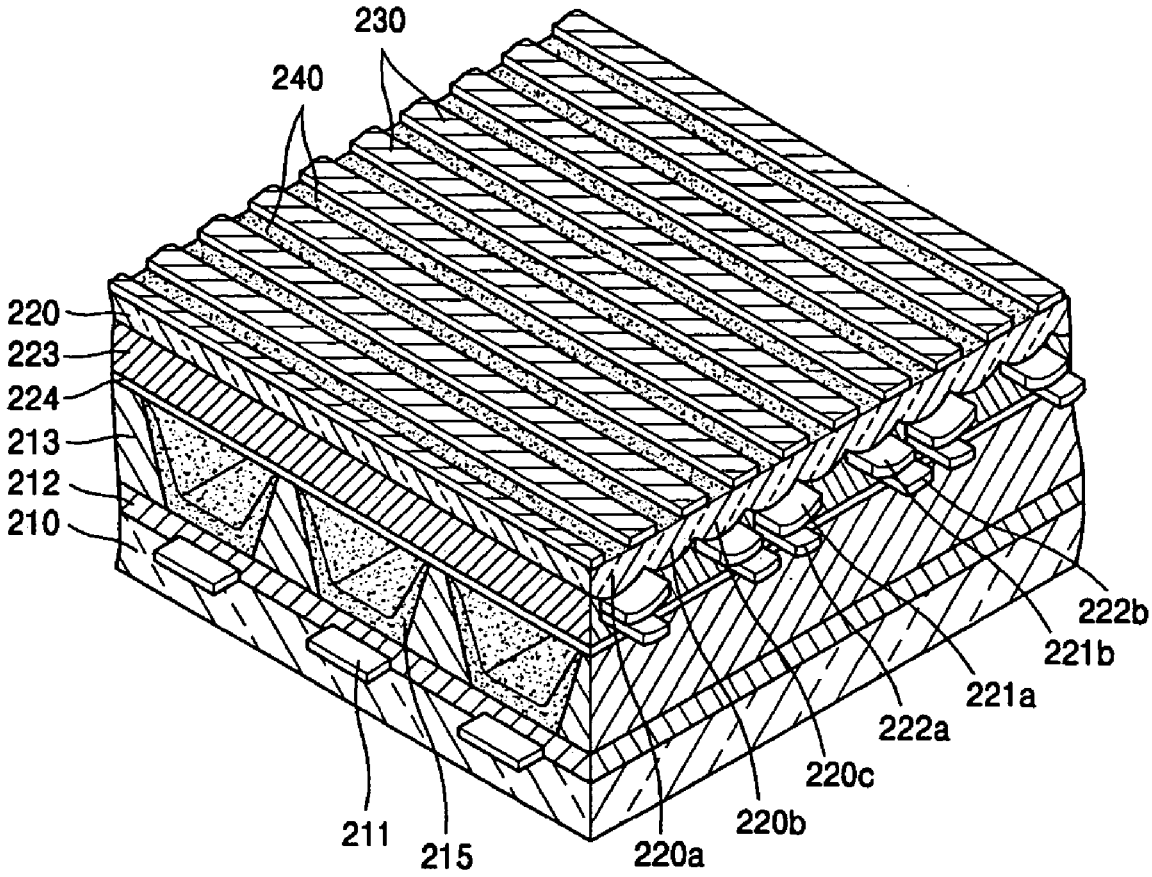
FIG. 6 is a cutaway perspective view of a PDP according to another embodiment of the present invention.
Figure 7:
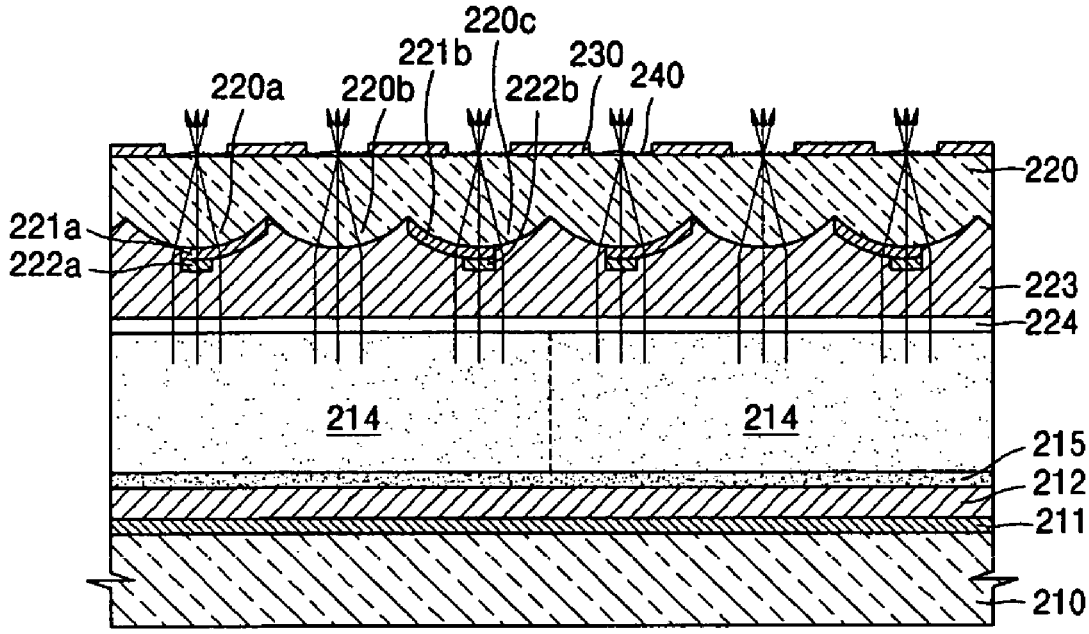
FIG. 7 is a cross-sectional view illustrating the inner structure of the PDP of FIG. 6.

FIG. 6 is a cutaway perspective view of a PDP according to another embodiment of the present invention, and FIG. 7 is a cross-sectional view illustrating the inner structure of the PDP of FIG. 6.

Referring to FIGS. 6 and 7, the PDP comprises a lower substrate 210 and an upper substrate 220 that are spaced apart from each other by a predetermined distance. A discharge space is formed between the lower substrate 210 and the upper substrate 220.

On the lower substrate 210, a plurality of address electrodes 211 and a first dielectric layer 212 are preferably sequentially formed.

A plurality of barrier ribs 213 are formed parallel to the address electrodes 211, at a predetermined spacing, on the first dielectric layer 212. The barrier ribs 213 partition the discharge space between the lower substrate 210 and the upper substrate 220, thereby defining discharge cells 214. A fluorescent layer 215 is formed on the upper surface of the first dielectric layer 212, and the side surfaces of the barrier ribs 213 forming inner walls of the discharge cells 214. The discharge cells 214 are preferably filled with a discharge gas.

A plurality of cylindrical lenses 220*a*, 220*b* and 220*c* are formed on the lower surface of the upper substrate 220. The cylindrical lenses 220*a*, 220*b* and 220*c* correspond to each of the discharge cells 214, and are formed perpendicular to the address electrodes 211. It is preferable that the cylindrical lenses 220*a*, 220*b* and 220*c* are formed integral with the upper substrate 220, which can be performed by processing the lower surface of the upper substrate 220. As shown in FIG. 7, the cylindrical lenses 220*a*, 220*b* and 220*c* focus the visible lights generated in the discharge cells 214 and emit visible light out of the PDP. Although the present embodiment shows three cylindrical lenses 220*a*, 220*b* and 220*c* corresponding to each of the discharge cells 214, the number of cylindrical lenses corresponding to each of the discharge cells 214 may be changed to two or four or more.

On the lower surfaces of the cylindrical lenses 220*a*, 220*b* and 220*c*, first and second discharge electrodes 221*a* and 221*b* for sustaining a discharge are formed in a pair for each discharge cell 214 and are formed perpendicular to the address electrodes 211. On the lower surface of the first and second discharge electrodes 221*a* and 221*b*, first and second bus electrodes 222*a* and 222*b*, which are preferably made of metal, are formed.

A second dielectric layer 223 is preferably formed on the lower surface of the cylindrical lenses 220*a*, 220*b* and 220*c*, to cover the first and second discharge electrodes 221*a* and 221*b* and the first and second bus electrodes 222*a* and 222*b*. A protective layer 224 is formed on the lower surface of the second dielectric layer 223.

An external light shielding member is provided on the upper surface of the upper substrate 220 to prevent external light from entering the discharge cells 214 through the upper substrate 220. The external light shielding member is preferably formed of a plurality of parallel stripes 230 (preferably black) on the upper surface of the upper substrate 220 at a predetermined spacing. The stripes 230 are of constant width and are parallel with the cylindrical electrodes 220*a*, 220*b* and 220*c*. The stripes 230 are formed where no visible light is emitted by the discharge cells 214. Non-glare treatments are applied to portions of the upper surface 240 of the upper substrate 220 between the stripes 230. The stripes 230 may include a conductive film for shielding electromagnetic interference (EMI).

Figure 8:
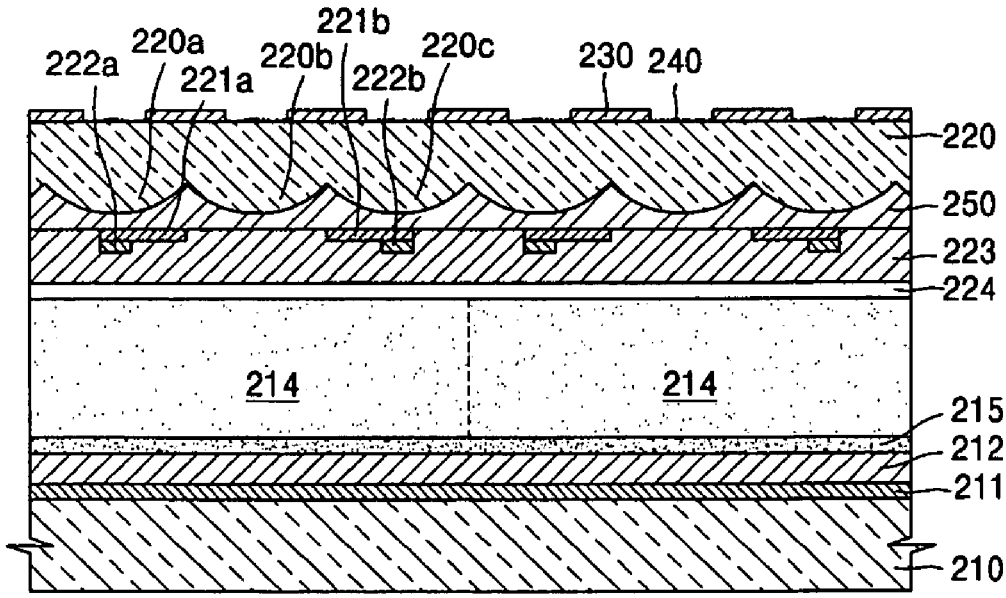
FIG. 8 is a cross-sectional view illustrating a modification of the PDP of FIG. 6.

FIG. 8 is a cross-sectional view illustrating a modification of the PDP of FIG. 6. Referring to FIG. 8, a transparent material layer 250 is formed to cover the lower surfaces of the cylindrical lenses 220*a*, 220*b* and 220*c*. First and second discharge electrodes 221*a* and 221*b* are preferably formed on the flat lower surface of the transparent material layer 250. First and second bus electrodes 222*a* and 222*b* are formed on the lower surfaces of the first and second discharge electrodes 221*a* and 221*b*. Also, a second dielectric layer 223 is formed on the lower surface of the transparent material layer 250 to cover the first and second discharge electrodes 221*a* and 221*b* and the first and second bus electrodes 222*a* and 222*b*. The transparent material layer 250 aids in forming the first and second discharge electrodes 221*a* and 221*b* and the first and second bus electrodes 222*a* and 222*b*.

Figure 9:
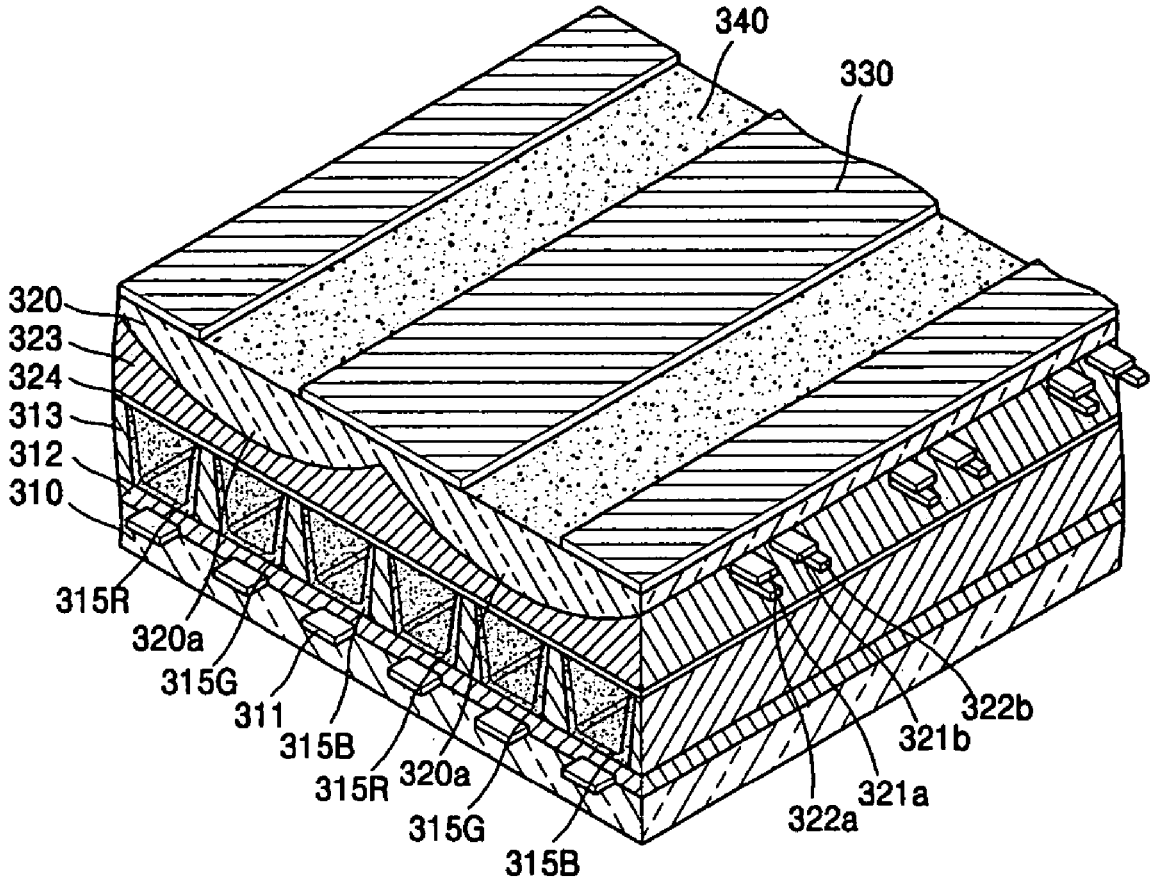
FIG. 9 is a cutaway perspective view of a PDP according to a further embodiment of the present invention.
Figure 10:
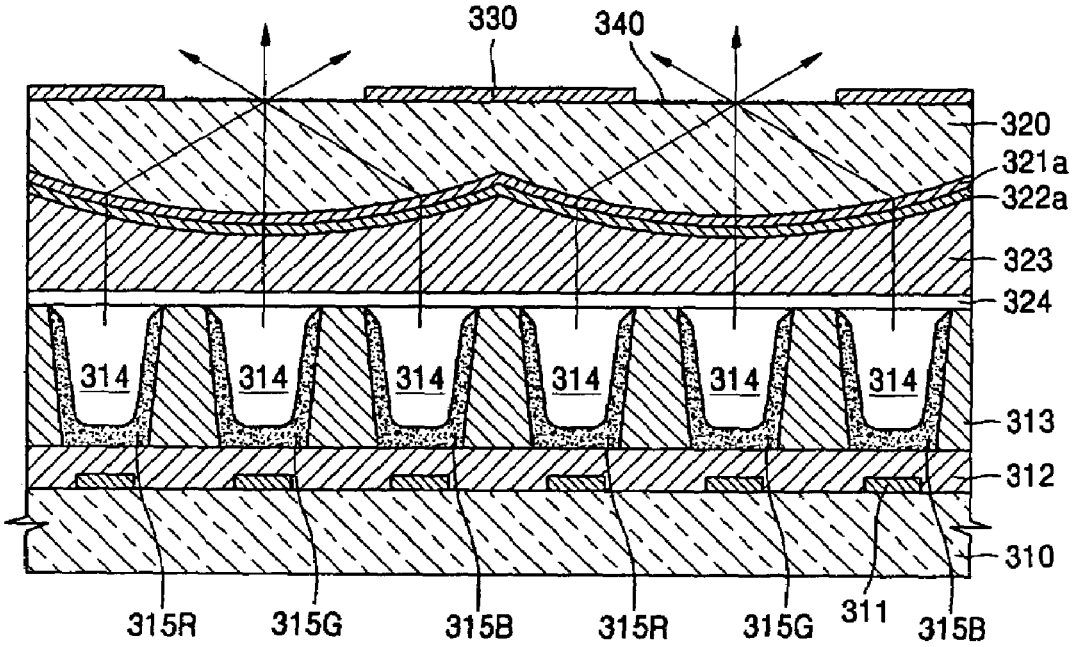
FIG. 10 is a cross-sectional view illustrating the inner structure of the PDP of FIG. 9.

FIG. 9 is a cutaway perspective view of a PDP according to a further embodiment of the present invention, and FIG. 10 is cross-a sectional view illustrating the inner structure of the PDP of FIG. 9.

Referring to FIGS. 9 and 10, the PDP comprises a lower substrate 310 and an upper substrate 320, spaced apart from each other by a predetermined distance. A discharge space is formed between the lower substrate 310 and the upper substrate 320. On the lower substrate 310, a plurality of address electrodes 311 and a first dielectric layer 312 are formed, preferably sequentially. A plurality of barrier ribs 313 are preferably formed parallel to the address electrodes 311 at a predetermined spacing on the first dielectric layer 312. The barrier ribs 313 partition the discharge space between the lower substrate 310 and the upper substrate 320, thereby defining discharge cells 314.

Red (R), green (G) and blue (B) fluorescent layers 315R, 315G and 315B are sequentially formed on the upper surface of the first dielectric layer 312, and side surfaces of the barrier ribs 313 forming the inner walls of the discharge cells 314. The discharge cells 314 are preferably filled with a discharge gas, which is a mixture of neon (Ne) and a small amount of xenon (Xe), as is generally used for plasma discharge.

A plurality of cylindrical lenses 320*a* are formed on the lower surface of the upper substrate 320. Each of the cylindrical lenses 320*a* corresponds to a plurality of the respective discharge cells 314. Preferably, each of the cylindrical lenses 320*a* corresponds to one pixel of the PDP as shown in FIGS. 9 and 10. In other words, each of the cylindrical lenses 320*a* corresponds to three discharge cells 314 in which the red (R), green (G) and blue (B) fluorescent layers 315R, 315G and 315B are formed. It is preferable that the cylindrical lenses 320*a* are formed integral with the upper substrate 320, which can be achieved by processing the lower surface of the upper substrate 320. As shown in FIG. 10, the cylindrical lenses 320*a* focus the visible light generated in the three discharge cells 314 in which the red (R), green (G) and blue (B) fluorescent layers 315R, 315G and 315B are formed and emit the visible light out of the PDP. Thus, the cylindrical lenses 320*a* on the lower surface of the upper substrate 320, each corresponding to one pixel, reduce the loss of visible light generated by discharge, thereby enhancing the brightness of the PDP. Also, since each of the cylindrical lenses 320*a* is shared by three discharge cells 314, the processing of the cylindrical lenses 320*a* is simpler and the PDP can be less expensive to manufacture.

On the lower surfaces of the cylindrical lenses 320*a*, first and second discharge electrodes 321*a* and 321*b* for sustaining discharge are formed in a pair for each discharge cell 314. The first and second discharge electrodes 321*a* and 321*b* are formed perpendicular to the address electrodes 311. On the lower surface of the first and second discharge electrodes 321*a* and 321*b*, first and second bus electrodes 322*a* and 322*b*, which are preferably made of metal, are formed. Also, a second dielectric layer 323 is formed on the lower surface of the cylindrical lenses 320*a*, to cover the first and second discharge electrodes 321*a* and 321*b* and the first and second bus electrodes 322*a* and 322*b*. A protective layer 324 is formed on the lower surface of the second dielectric layer 323.

An external light shielding member is provided on the upper surface of the upper substrate 320 to prevent external light from entering the discharge cells 314 through the upper substrate 320. The external light shielding member is preferably formed of a plurality of parallel stripes 330 (preferably black) on the upper surface of the upper substrate 320 at a predetermined spacing. The stripes 330 are preferably of a uniform width and are parallel with the address electrodes 311 and the cylindrical electrodes 320*a*. The stripes 330 are formed where no visible light is emitted by the discharge cells 314. Non-glare treatments are applied to portions of the upper surface 340 of the upper substrate 320 between the black stripes 330. The stripes 330 prevent external light from entering the discharge cells 314, thereby enhancing the contrast of the PDP when used in, for example, brightly lit room conditions. The stripes 330 may include a conductive film for shielding electro magnetic interference (EMI).

Figure 11:
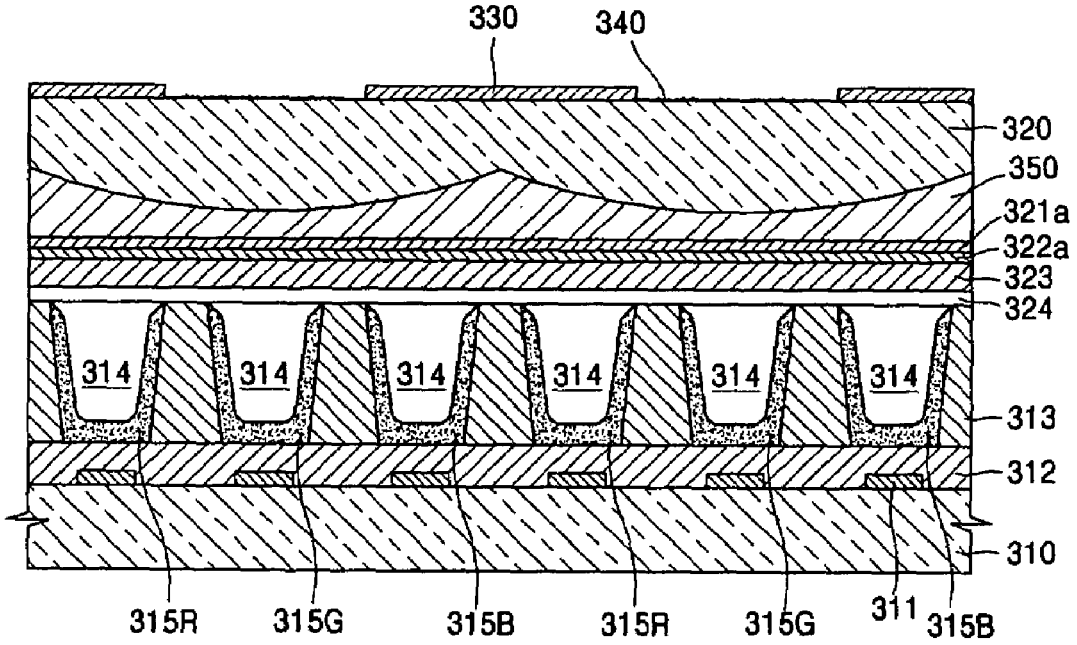
FIG. 11 is a cross-sectional view illustrating a modification of the PDP of FIG. 9.

FIG. 11 is a cross-sectional view illustrating an embodiment of the PDP of FIGS. 9 and 10. Referring to FIG. 11, a transparent material layer 350 is formed to cover the lower surfaces of the cylindrical lenses 320*a*. First and second discharge electrodes 321*a* and 321*b* are formed on the flat lower surface of the transparent material layer 350. First and second bus electrodes 322*a* and 322*b* are formed on the lower surfaces of the first and second discharge electrodes 321*a* and 321*b*. Also, a second dielectric layer 323 is formed on the lower surface of the transparent material layer 350, to cover the first and second discharge electrodes 321*a* and 321*b* and the first and second bus electrodes 322*a* and 322*b*. Thus, the transparent material layer 350 aids in forming the first and second discharge electrodes 321*a* and 321*b* and the first and second bus electrodes 322*a* and 322*b*.

As described above, the PDP made according to embodiments of the present invention has the following features:

First, a plurality of cylindrical lenses corresponds to each discharge cell, reducing the loss of visible lights generated in the discharge cells and enhancing the light integrity and brightness of the PDP.

Second, preferably black stripes can cover more of the upper surface of the upper substrate than in the conventional PDP, to more effectively prevent external light from entering the discharge cells, and enhance the contrast of the PDP when used in, for example, Brightly lit room conditions.

Third, one cylindrical lens corresponds to two or more discharge cells, making the formation of the cylindrical lenses 320*a* simpler, so that the PDP can be less expensive to manufacture.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, although the aforementioned embodiments show and describe an AC type surface discharge PDP, the present invention is not limited thereto but can be applied to a DC type PDP or a facing discharge PDP.

What is claimed is:

1. A plasma display panel comprising:

a lower substrate and an upper substrate configured to define a discharge space between an upper surface of the lower substrate and a lower surface of the upper substrate;

a plurality of barrier ribs between the lower substrate and the upper substrate, partitioning the discharge space to form a plurality of discharge cells;

a plurality of address electrodes formed in parallel on the upper surface of the lower substrate;

a plurality of discharge electrodes formed at an angle to the address electrodes on the lower surface of the upper substrate; and, a plurality of cylindrical lenses, at least one of the plurality of the cylindrical lenses corresponding to at least one of the discharge cells, formed on a lower surface of the upper substrate, for focusing visible light generated by discharge of the at least one of the discharge cells substantially onto an upper surface of the upper substrate, whereby the visible light is emitted out of the plasma display panel.

2. The plasma display panel of claim 1, wherein the at least one of the cylindrical lenses is formed integral with the upper substrate.

3. The plasma display panel of claim 1, wherein the cylindrical lenses are formed perpendicular to the address electrodes.

4. The plasma display panel of claim 3, wherein the upper substrate comprises an external light shielding member for preventing external light from entering the discharge cells, and the external light shielding member comprises a plurality of stripes formed perpendicular to the address electrodes on the upper surface of the upper substrate.

5. The plasma display panel of claim 4, wherein the stripes are formed where no visible lights is emitted by the discharge cells.

6. The plasma display panel of claim 4, wherein the stripes comprise a conductive film for shielding electromagnetic interference.

7. The plasma display panel of claim 4, wherein the upper surface of the upper substrate between the stripes is non-glare treated.

8. The plasma display panel of claim 1, wherein the discharge electrodes are formed on the lower surfaces of the cylindrical lenses.

9. The plasma display panel of claim 1, wherein a transparent material layer is formed to cover the lower surfaces of the cylindrical lenses.

10. The plasma display panel of claim 9, wherein the discharge electrodes are formed on the lower surface of the transparent material layer.

11. The plasma display panel of claim 1, wherein the barrier ribs are formed parallel to the address electrodes.

12. The plasma display panel of claim 1, wherein bus electrodes are formed on the lower surfaces of the discharge electrodes.

13. The plasma display panel of claim 1, wherein a first dielectric layer covering the address electrodes is formed on the upper surface of the lower substrate.

14. The plasma display panel of claim 13, wherein a second dielectric layer covering the discharge electrodes is formed on the lower surface of the upper substrate.

15. The plasma display panel of claim 14, wherein a protective layer is formed on the lower surface of the second dielectric layer.

16. The plasma display panel of claim 1, wherein the at least one of the plurality of the cylindrical lenses corresponds to at least two of the discharge cells, the at least one of the plurality of the cylindrical lenses focusing the visible light generated by discharge of the at least two of the discharge cells substantially onto an upper surface of the upper substrate.

17. The plasma display panel of claim 16, wherein each of the cylindrical lenses corresponds to three discharge cells forming one pixel.

18. The plasma display panel of claim 16, wherein the cylindrical lenses are formed parallel to the address electrodes.

19. The plasma display panel of claim 16, wherein the cylindrical lenses are formed integral with the upper substrate.

20. The plasma display panel of claim 16, wherein the discharge electrodes are formed on the lower surfaces of the cylindrical lenses.

21. The plasma display panel of claim 16, wherein a transparent material layer is formed to cover the lower surfaces of the cylindrical lenses.

22. The plasma display panel of claim 21, wherein the discharge electrodes are formed on the lower surface of the transparent material layer.

23. The plasma display panel of claim 16, wherein the upper substrate comprises an external light shielding member for preventing external light from entering the discharge cells, and the external light shielding member comprises a plurality of stripes formed parallel to the address electrodes on the upper surface of the upper substrate.

24. The plasma display panel of claim 23, wherein the stripes are formed where no visible lights is emitted by the discharge cells.

25. The plasma display panel of claim 23, wherein the stripes comprise a conductive film for shielding EMI.

26. The plasma display panel of claim 23, wherein the upper surface of the upper substrate between the stripes is non-glare treated.

27. The plasma display panel of claim 16, wherein the barrier ribs are formed parallel to the address electrodes.

28. The plasma display panel of claim 16, wherein bus electrodes are formed on the lower surfaces of the discharge electrodes.

29. The plasma display panel of claim 16, wherein a first dielectric layer covering the address electrodes is formed on the upper surface of the lower substrate.

30. The plasma display panel of claim 29, wherein a second dielectric layer covering the discharge electrodes is formed on the lower surface of the upper substrate.

31. The plasma display panel of claim 30, wherein a protective layer is formed on the lower surface of the second dielectric layer.

32. The plasma display panel of claim 1, wherein the upper substrate comprises an external light shielding member for preventing external light from entering the discharge cells.

33. The plasma display panel of claim 1, further comprising a fluorescent layer formed on the inner walls of the discharge cells.

34. The plasma display panel of claim 1, wherein the cylindrical lenses are formed parallel to the address electrodes.

35. The plasma display panel of claim 34, wherein the upper substrate comprises an external light shielding member for preventing external light from entering the discharge cells, and the external light shielding member comprises a plurality of stripes formed parallel to the address electrodes on the upper surface of the upper substrate.

36. The plasma display panel of claim 35, wherein the stripes are formed where no visible lights are emitted by the discharge cells.

37. The plasma display panel of claim 35, wherein the stripes comprise a conductive film for shielding electromagnetic interference.

38. The plasma display panel of claim 35, wherein the upper surface of the upper substrate between the stripes is non-glare treated.

39. A plasma display panel comprising:

a lower substrate and an upper substrate, spaced apart by a predetermined distance to define a discharge space therebetween;

a plurality of barrier ribs between the lower substrate and the upper substrate, partitioning the discharge space to form a plurality of discharge cells;

a plurality of address electrodes formed in parallel on the upper surface of the lower substrate;

a plurality of discharge electrodes formed at an angle to the address electrodes on the lower surface of the upper substrate;

a fluorescent layer formed on the inner walls of the discharge cells; and an external light shielding member formed on the upper substrate, for preventing external light from entering the discharge cells, wherein the upper substrate has a plurality of cylindrical lenses, corresponding to each of the discharge cells, formed on the lower surface of the upper substrate, to focus visible light generated by discharge and emit the visible light out of the plasma display panel, and wherein the cylindrical lenses are formed parallel to the address electrodes.

40. The plasma display panel of claim 39, wherein the external light shielding member comprises a plurality of stripes formed parallel to the address electrodes on the upper surface of the upper substrate.

41. The plasma display panel of claim 40, wherein the stripes are formed where no visible lights are emitted by the discharge cells.

42. The plasma display panel of claim 40, wherein the stripes comprise a conductive film for shielding electromagnetic interference.

43. The plasma display panel of claim 40, wherein the upper surface of the upper substrate between the stripes is non-glare treated.

44. A plasma display panel comprising:

a lower substrate comprising a first upper surface and a first lower surface;

an upper substrate comprising a second upper surface and a second lower surface;

a discharge space configured between the first upper surface and the second lower surface, and partitioned into a plurality of discharge cells; and at least one lens configured on the second lower surface for focusing visible light generated within at least one of the discharge cells substantially onto the second upper surface.

* * * * *